US008083321B2

(12) United States Patent
Krawczyk et al.

(10) Patent No.: US 8,083,321 B2
(45) Date of Patent: Dec. 27, 2011

(54) REMOVABLE RADIATION CURED COMPOSITION AND PROCESS FOR PROTECTING A MICRO-FLUID EJECTION HEAD

(75) Inventors: Karina Anne Krawczyk, Richmond, KY (US); Bart Allan Mansdorf, Lexington, KY (US); Dell T. Rosa, Winchester, KY (US); Paul Timothy Spivey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1082 days.

(21) Appl. No.: 11/752,342

(22) Filed: May 23, 2007

(65) Prior Publication Data

US 2008/0292807 A1 Nov. 27, 2008

(51) Int. Cl.
*B41J 2/135* (2006.01)

(52) U.S. Cl. ..... 347/45

(58) Field of Classification Search ..... None
See application file for complete search history.

(56) References Cited

U.S. PATENT DOCUMENTS

| | | | | |
|---|---|---|---|---|
| 4,591,615 | A * | 5/1986 | Aldred et al. | 525/179 |
| 4,623,676 | A * | 11/1986 | Kistner | 522/15 |
| 5,380,358 | A * | 1/1995 | Aoki et al. | 106/31.43 |
| 6,302,523 | B1 * | 10/2001 | Smith et al. | 347/45 |
| 6,409,325 | B1 * | 6/2002 | Matsumoto et al. | 347/87 |
| 6,634,732 | B2 * | 10/2003 | Farr et al. | 347/29 |
| 2006/0221119 | A1 * | 10/2006 | Bertelsen et al. | 347/29 |

* cited by examiner

*Primary Examiner* — Matthew Luu
*Assistant Examiner* — Alejandro Valencia

(57) ABSTRACT

There is disclosed a removable radiation cured member suitable for use in protecting a micro-fluid ejection head. Further, a reactant mixture suitable for sealing a micro-fluid ejection head comprising a vinyl-containing oligomer, a filler, and optionally a reactive diluent and/or a photoinitiator is disclosed.

37 Claims, 6 Drawing Sheets

*Prior Art*

REMOVABLE RADIATION CURED COMPOSITION AND PROCESS FOR PROTECTING A MICRO-FLUID EJECTION HEAD

TECHNICAL FIELD

The present disclosure relates to compositions and methods for radiation cured members suitable for use in protecting micro-fluid ejection heads.

BACKGROUND AND SUMMARY

The present disclosure relates to the protecting of nozzles 100 or a nozzle area 102 on a micro-fluid ejection head 104. A schematic depiction is shown in FIG. 1. A major problem in maintaining a robust seal on such a device is the highly demanding and sometimes conflicting requirements for such an application. For example, the sealant material must coat the nozzles, thereby preventing fluid from leaking out of the nozzles for the entire "shelf life" of the ejection head. In addition, the sealant must be compatible with the fluid contained within the ejection head. Ideally, the sealant should not alter the properties of the fluid and it should not dissolve or appreciably swell when in contact with the fluid. The fluid should also not interfere with the ability of the sealant material to adhere to the surface of the ejection head. The sealant should also provide a physical barrier that not only prevents intermixing and/or contamination with other fluids and/or the external environment, it should prevent evaporation of any volatile components within the fluid. Also, the sealant should remove cleanly from the ejection head leaving a minimum amount of residue on the ejection head and nozzles so as to not affect the subsequent print (via misdirection or missing droplets on the page, for example). Conventionally, the primary sealant material has been an acrylate-based pressure sensitive adhesive ("PSA") tape 106, an example of which is shown in FIG. 1. However, as the size of the ejection head nozzles has decreased and the complexity of the fluid components has grown with each new generation of printers, the ability of a PSA tape 16 to meet these application requirements has diminished drastically.

To better understand where the challenge lies in using a PSA tape for this type of application, it is necessary to describe how a PSA tape works. An example of a PSA tape is provided in U.S. Pat. No. 4,181,752. Typically, PSA tapes are copolymers of a major proportion of alkyl esters of acrylic acid (the alkyl group containing from about four to fourteen carbon atoms) and a minor proportion of at least one "modifying monomer" (also referred to as an adhesion promoter) such as acrylic acid, methacrylic acid, acrylamide, acrylonitrile, methacrylonitrile, N-vinyl pyrrolidinone, maleic anhydride, or itaconic acid. This type of copolymer is effective as a tape due to the soft nature of the polymer which enables efficient and rapid "wetting" of the substrate. Efficient coverage, or wetting, also maximizes surface area coverage and/or interaction between the adhesive tape and substrate. As the degree of coverage increases, the strength of the bond between the two surfaces increases. It is also a common practice to add multifunctional reactants (such as trimethylolpropane triacrylate) during the polymerization of these acrylate and "modifying" monomers. These multifunctional reactants act as crosslinking agents during the polymerization of these adhesive tapes, thereby increasing the molecular weight and cohesive strength of the resulting adhesive tape.

From a practical perspective, PSA tapes are classified based on two basic properties: compliance (the ability of the tape to conform to a substrate being adhered to) and cohesive strength (the ability of the tape to resist deformation under load). Compliance comes from the soft nature (low Tg) of the polymer in the adhesive tape while the cohesive strength arises from the chemical makeup, crosslink density, and molecular weight of the adhesive tape. However, these two properties are generally opposed to one another. For example, if a tape is too firm (resulting from a high crosslink density), its ability to "wet" or comply with the surface being bonded will be lacking. On the other hand, if a tape is too compliant, it will lack the strength necessary to maintain the bond under an applied load. Therefore, a delicate balance is always present when designing a tape for a specific application.

For the case of sealing a micro-fluid ejection head, maintaining an acceptable balance of compliance and cohesive strength has proven to be very difficult. It is now commonly observed that a PSA tape, which is sufficiently compliant to seal a micro-fluid ejection head, typically does not remove cleanly due to a lack of cohesive strength. The exact opposite case has been equally problematic; namely, adhesive tapes that have sufficient cohesive strength (for clean removal) typically do not seal the ejection head due to their lack of compliance. However, since both aspects are equally vital for the overall functional performance of a micro-fluid ejection head sealant, a compromise between these two properties is not an option. Therefore, it has become necessary to investigate more robust sealing options. Such an option is presented in the present disclosure.

In accordance with the disclosure, there is disclosed a reactant mixture suitable for sealing a micro-fluid ejection head comprising a vinyl-containing oligomer, a filler, and optionally a reactive diluent, and/or a photoinitiator.

Another embodiment comprises a method of protecting a nozzle area containing nozzles on a micro-fluid ejection head with a removable cured member comprising applying a reactant mixture to a nozzle area containing nozzles on a micro-fluid ejection head and exposing the reactant mixture to radiation to provide a removable cured member. The method may further comprise removing the removable cured member from the nozzle area. The method may also further comprise attaching a removal member to the nozzle area.

Another embodiment comprises a micro-fluid ejection head having nozzles sealed by a removable radiation cured member, wherein the removable radiation cured member comprises the reaction product of a vinyl-containing oligomer, a filler, and optionally a reactive diluent, and/or a photoinitiator.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description and figures are exemplary and explanatory only and are not restrictive of the disclosure, as claimed.

DESCRIPTION OF THE EMBODIMENTS

For the application of protecting a micro-fluid ejection head, it is desirable to retain the sealability of a viscous liquid while achieving the cohesive strength of a highly crosslinked thermoset. The present disclosure provides a chemical composition, comprising a variety of reactive or "polymerizable" materials (vinyl-containing oligomers and reactive diluents, fillers/additives, and photoinitiators) which may be applied to a micro-fluid ejection head as a liquid. Because of the application in a liquid state, this material can achieve excellent coverage of the ejection head and nozzles without being hindered by any internal cohesion or chemical crosslinks. This material may then be subjected to a secondary "curing" process (for example, UV-radiation) to initiate a polymerization and chemically crosslink the material to a high molecular weight, solid mass. In this manner, sealability is achieved by coating in the liquid state while cohesive strength is achieved by generating a highly crosslinked system (after coating) with a secondary process. This "secondary" process Involves the use of electromagnetic radiation in the form of ultraviolet, visible, or electron beam radiation which generates a sealant in-situ.

A radiation cured member may comprise a coating, a film, a sealant, or the like that is removable from an ejection head. The radiation cured member may comprise materials that may be polymerized and/or cross-linked from low molecular weight monomers and oligomers through initiation by a radiation source. The radiation source may be visible light, ultraviolet light, or an electron beam. Polymerization or cross-linking may occur via a chain-growth mechanism, for example, a free radical propagating species, which is extremely fast and may involve virtually any type of organic compound with one or more vinyl acrylate, methacrylate, or similar functional groups. Unlike conventional coatings, radiation cured coatings may be applied without the use of organic solvents. The entire composition of the member formulation may be comprised of "polymerizable" monomers, which react to form high molecular weight polymeric coating upon exposure to radiation. This "100% solids" approach eliminates the need for solvent recovery systems, reduces health risks, and is often more economical due to the reduced waste and potentially higher process speeds. In fact, radiation-initiated free radical polymerizations typically cure within fractions of a second.

Figure 1:
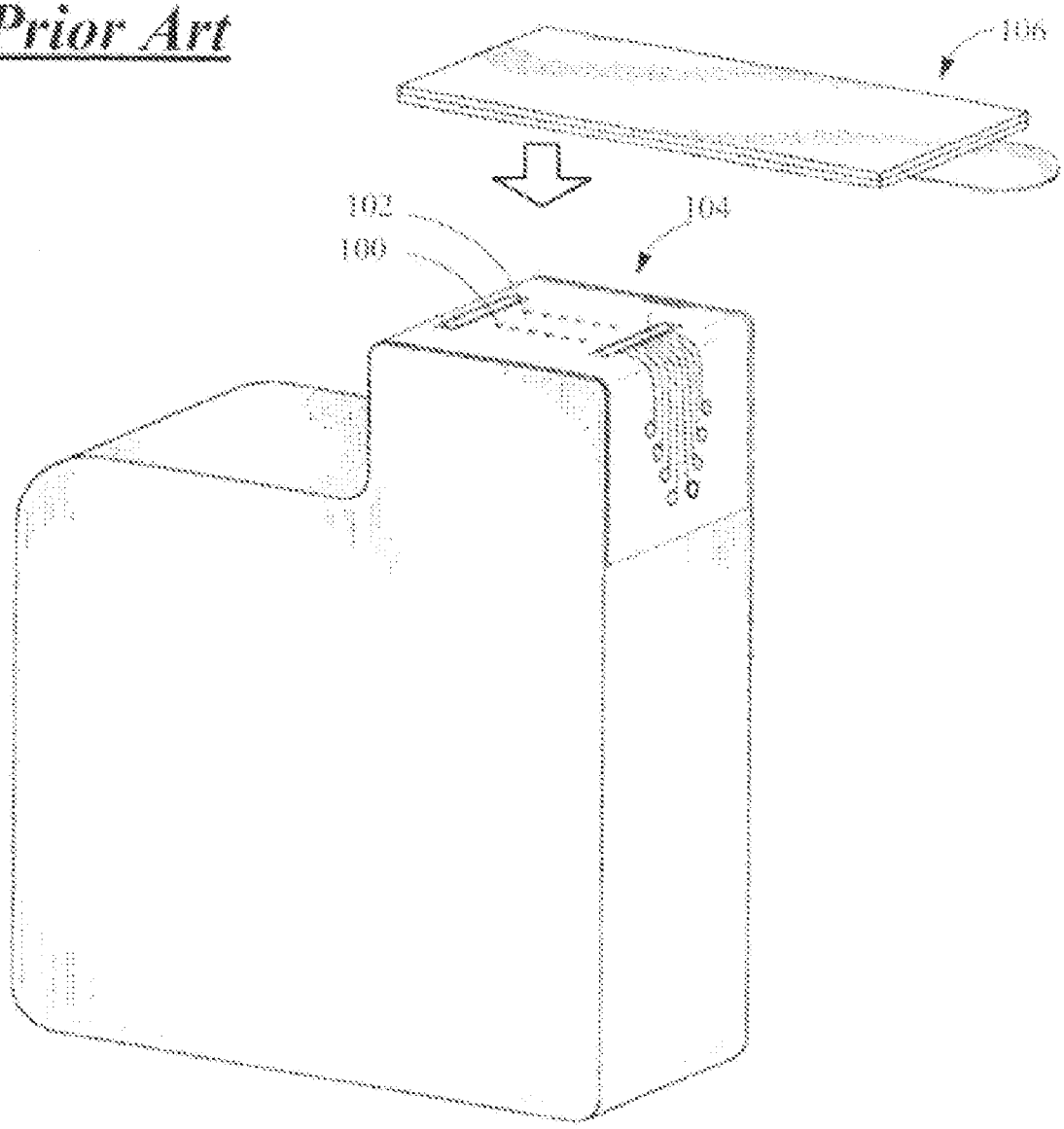
FIG. 1 is a perspective view of a prior art pressure sensitive adhesive tape used for sealing nozzles of a micro-fluid ejection head.
Figure 2:
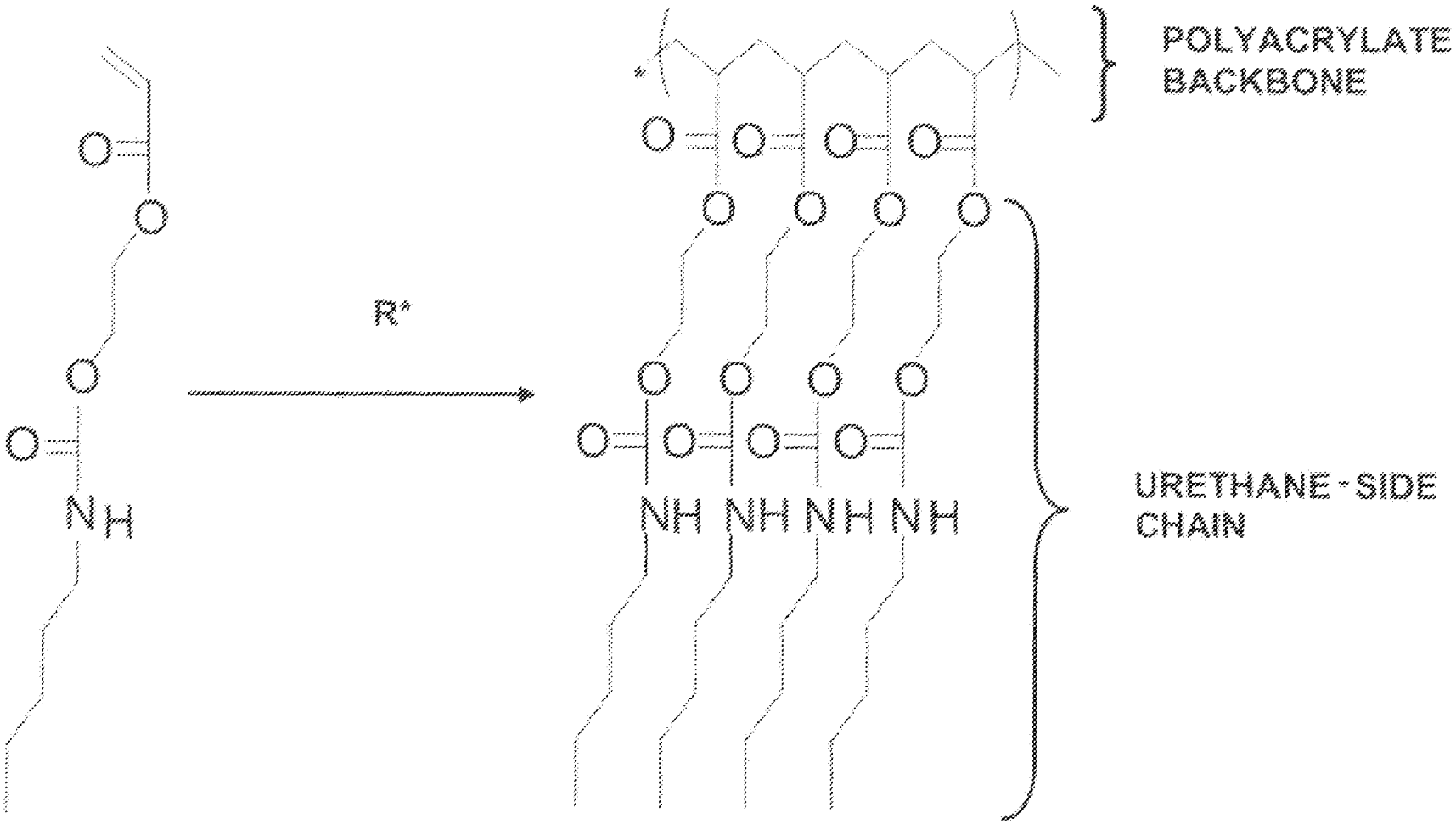
FIG. 2 is a molecular structure of a free-radically polymerized monofunctional urethane acrylate.

Radiation cured members may comprise a wide range of polymer design including olefinic-, urethane-, urea-, siloxane-, fluoropolymer-, epoxy-, ester-, amide-, amine-, ether-, acrylic- and other functionalities. These types of functional groups may or may not make up the "reactive" species that participate in a radiation-initiated crosslinking/polymerization reaction. For example, and most often, these functional groups are "pendant" to a vinyl-functionalized monomer or oligomer. These "pendant" functional groups, once polymerized, may either become a side chain off a polymer backbone (if the reactant is monofunctional) or part of a polymer backbone (if the reactant has functionality greater than or equal to two). Examples of functionalized vinyl reactants that become side chains or part of the polymer backbone are shown in FIG. 2. Specifically, FIG. 2 shows a monofunctional acrylate monomer containing a urethane functional group such as the monomer available from Rahn Company of Zurich, Switzerland under the trade name GENOMER 1122. When this material is polymerized through a free radical mechanism, the predominant product is a linear acrylate homopolymer that has the "urethane" linkages pendant to the polymer backbone.

Figure 3:
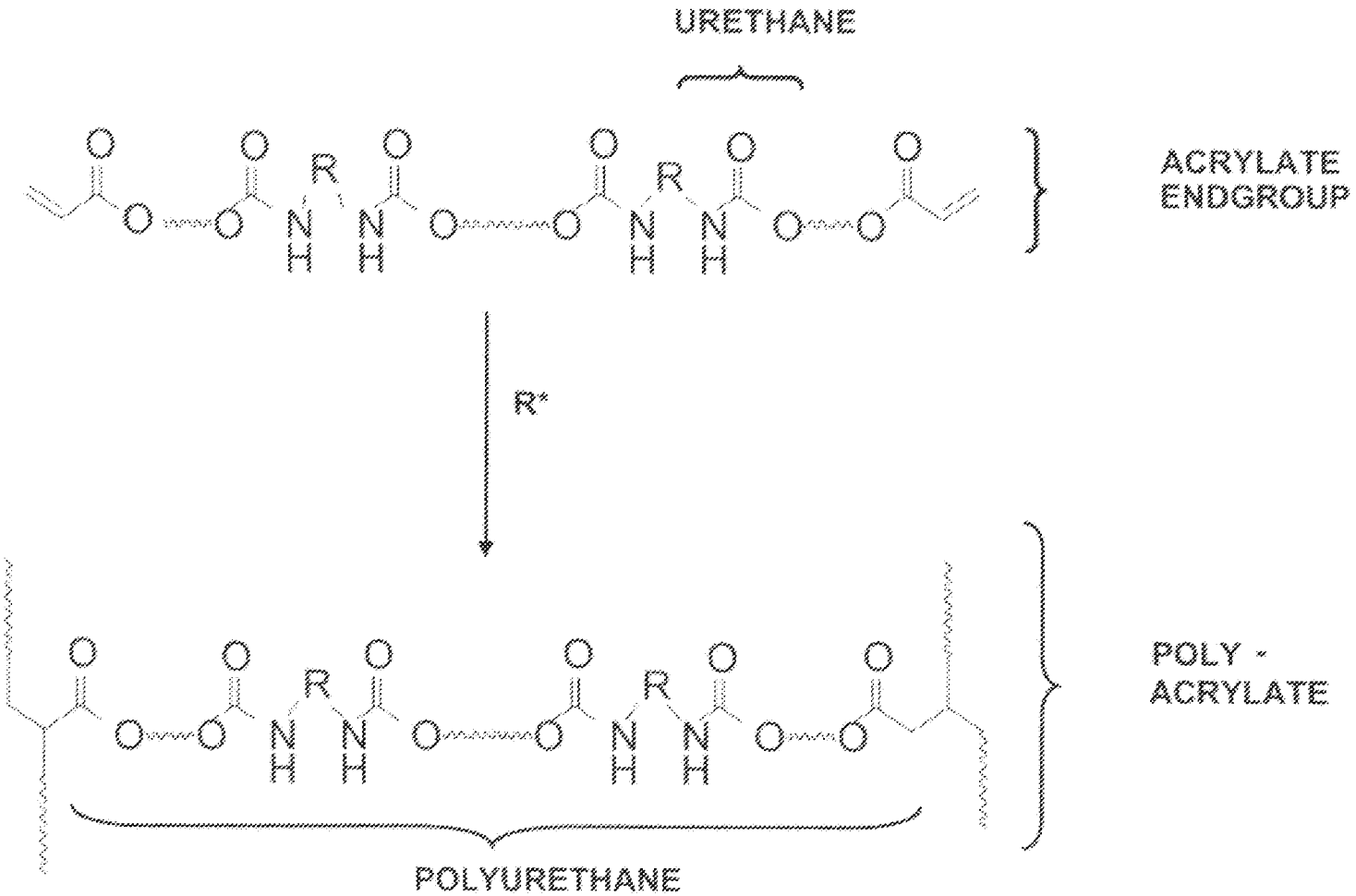
FIG. 3 is a molecular structure of a free-radically polymerized urethane diacrylate oligomer.

However, a difunctional (or higher functionality) material in the same class provides a polymer with a different molecular architecture. The material depicted in FIG. 3 has the same general functionality as the material in FIG. 2 in that it contains both acrylate and urethane functional groups. However, since it contains more than one reactive group (i.e., acrylate end-groups), this material may function as a crosslinking agent. In that case, the urethane linkages will be in the "backbone" of the polymer resulting in a "cured" member, or sealant, mixture that contains a mixture of poly(urethane) and poly(acrylate) linkages.

Reactant Mixture

Embodiments may comprise a reactant mixture composed of reactive monomers and oligomers that may be cured via a free radical mechanism. Further, the reactant mixture may comprise one or more of reactive diluents, fillers/additives, and initiators. Suitable monomers and oligomers may contain a polymerizable functionality such as acrylate, methacrylate, vinyl ether, or any suitable vinyl functionality. They may undergo a polymerization reaction in the presence of free radicals either introduced externally or catalyzed internally from raw materials such as photoinitiators or generated by the radiation source, such as an electron beam.

The oligomers may comprise a major component in the reactant mixture, for example, about 50 wt. % or more of the reactant mixture. The oligomers may comprise one or more aliphatic and aromatic linkages including combinations thereof. The oligomers may comprise a molecular weight of from about 1,500 to about 20,000 g/mole. The oligomers may comprise about 1 to about 6 (meth)acrylate/vinyl groups per molecule. As used herein, the term acrylate is intended to include vinyl components. Functional groups contained within the oligomer may include, but are not limited to, a urethane (for example the urethane available from Cytec Industries Inc. of West Paterson, N.J. sold under the trade name EBECRYL 244), a siloxane (for example, the siloxane available from Cytec sold under the trade name EBECRYL 1360), an ester (for example, the ester available from Cytec sold under the trade name EBECRYL 524), an ether (for example the ether available from Sartomer Company, Inc. of Exton, Pa. sold under the trade name SR-415), an epoxy-derived component (for example the epoxy-derived compound available from Cytec sold under the trade name EBECRYL 3708), an amine-containing component (for example the amine available from Cytec sold under the trade name EBECRYL 7100), an olefinic component (for example the olefin available from Sartomer sold under the trade name CN-307), and an acrylate functionalized polyacrylate (for example the acrylic component available from Cytec sold under the trade name EBECRYL 745).

The diluent may comprise one or more of a (meth)acrylate or a vinyl reactive diluent. The reactive diluent may impart certain properties to the reactant mixture or the resulting cured member, or sealant, such as viscosity control, adhesion, flexibility (Tg), wetting, and solvent resistance. The diluent may comprise about 40 wt. % or less of the reactant mixture.

In some embodiments a non-reactive diluent may be optionally included. The diluent may comprise one or more aliphatic and aromatic linkages including combinations thereof. The diluent may comprise a molecular weight of from about 50 to about 1500 g/mole. The diluent may comprise about 1 to about 6 (meth)acrylate/vinyl groups per molecule. Functional groups contained within the diluent component may include, but are not limited to, a urethane (for example the urethane available from Rahn sold under the trade name GENOMER 1122), a siloxane (for example the siloxane available from Cytec sold under the trade name EBECRYL 350), an ester (for example, isobornyl acrylate), an ether (for example, 2(2-ethoxyethoxy)ethyl acrylate), a metallic acrylate (for example the metallic acrylate available from Sartomer sold under the trade name SR-9016), a fluorine-containing component (for example, 2,2,2-trifluoroethyl methacrylate), a vinyl ether (for example, octadecyl vinyl ether), a thiolene (for example, trimethylolpropane tris(3-mercaptopropionate)), an n-vinyl pyrrolidone, a styrene, a vinyl acetate, a maleic anhydride, and a maleimide. Examples of reactive diluents include, but are not limited to an aliphatic urethane acrylate such as GENOMER 1122 and a diacrylate of propoxylated neopentyl glycol such as NPG(PO)2DA (from Cytec Industries).

The filler may comprise about 20 wt % or less of the reactant mixture. The reactant mixture may comprise one or more fillers. The filler may be inorganic or organic. For example, the filler may comprise one or more of, but not limited to, a hydrophobic fumed silica (such as AEROSIL R972 from Degussa of Parsippany, N.J.), a hydrophilic fumed silica (such as AEROSIL R8200 available from Degussa of Parsippany, N.J.), polymethyl methacrylate (PMMA) spherical beads (for example PMMA beads available from Esprix Technologies of Sarasota, Fla., sold under the trade name MX-300), and polymethylsilsesquioxane (for example the compound available from Toshiba of Tokyo, Japan, sold under the trade name TOSPEARLS 240).

The initiator (or photoinitiator) may comprise about 10 wt % or less of the reactant mixture. The initiator is an optional component in the reactant mixture. For example, it is optional when curing is initiated by an electron beam. The initiator may be any suitable Norrish Type I compound, a Norrish Type II compound, or combination thereof (as defined in "Radiation Curing of Coatings" by J. Koleske, p. 37-38, Bridgeport N.J., ASTM International 2002). Examples of suitable Norrish Type I compounds include, but are not limited to alpha-hydroxy ketones (for example the ketone available from Ciba Specialty Chemicals Inc. of Basel, Switzerland sold under the trade name IRGACURE 184), acylphosphines (for example the acylphophine available from Ciba under the trade name DAROCUR TPO), and aminoalkylphenones (for example the alkylphenone available from Ciba under the trade name IRGACURE 369), Norrish Type I compounds function by homolytic cleavage upon UV exposure producing 2 radicals. Examples of Norrish Type II compounds include, but are not limited to benzophenones (for example the benzophenone available from Cytec under the trade name ADDITOL ITX). Norrish Type II compounds function by hydrogen-abstraction thereby producing a radical Norrish Type II compounds may perform in the presence of Norrish Type II co-initiators, which provide "abstractable" protons. Suitable Norrish Type II co-initiators include, but are not limited to primary, secondary, and tertiary amines and ethers.

The reactant mixture may have a viscosity of from about 10 to about 10,000,000 centipoise (cps), prior to cure, at room temperature. Furthermore, the reactant mixture may achieve the desired physical, electrical, and chemical properties through the use of any acrylate, methacrylate, vinyl ether, or vinyl monomer or oligomer with or without the incorporation of particulate, metallic, ceramic, inorganic, ionic, or polymeric fillers. The reactant mixture may be 100% reactive or may incorporate water or organic solvents as a diluent. Finally, the reactant mixture may be applied in one or more layers limited only by the maximum thickness of the final cured member, or sealant stack.

Process

In some embodiments, the reactant mixture is applied directly to a surface. The surface may comprise a nozzle area of a micro-fluid injection device. As used herein, a nozzle describes an opening or hole used for ejecting a fluid from a micro-fluid election head. A micro-fluid ejection head typically has an area containing more than one nozzle. The nozzles are typically convergent, narrowing down from a wide diameter to a smaller diameter in the direction of the flow. The nozzle area may also be referred to as an orifice plate. The micro-fluid ejection head may contain a fluid, or liquid mixture, for example, an ink. The reactant mixture may be cured to provide a cured member, or sealant for the nozzles or nozzle area of the ejection head. Further, the reactant mixture may be applied to and cured to protect the electrical connections on the electrical circuit of the micro-fluid ejection head. In order to cure or solidify the reactant mixture, a radiation source may be used. Suitable radiation sources include ultraviolet (UV) light, visible light, and electron beams. In another example, radiation curing systems may employ inert atmospheres to enhance surface cure by preventing free radical scavenging by oxygen. Inert atmospheres may be generated using nitrogen, argon, or other non-reactive gases as well as liquid or solid interfaces. Radiation, sources may be optimized, directed, focused, or dispersed by means of optical mirrors and lenses, dichroic filters, and electromagnetic lenses.

The reactant mixture may be applied as a single layer or as more than one layer. If applied as multiple layers, the reactant mixture may be cured between application of each additional layer. Alternatively more than one layer may be applied and the layers may be cured after the application of all desired layers. Further alternatively, the layers may be applied and cured in any desired order.

Figure 4:
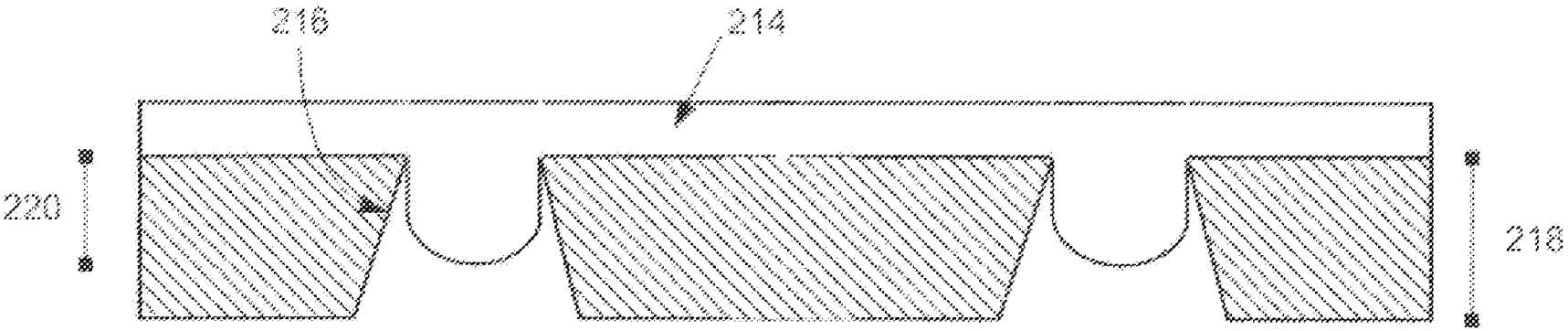
FIG. 4 is a cross-sectional view, not to scale, of a nozzle protected with a radiation cured member according to the disclosure

The reactant mixture may be applied to a nozzle area containing nozzles of a micro-fluid ejection head by any suitable means, for example, but not limited to, extrusion, roll coating, spraying, stencil printing, or dispensing through, a needle. Particularly suitable is an embodiment where the reactant mixture is dispensed through a needle onto a nozzle area. FIG. 4 is an illustration of a reactant mixture 214 applied to a nozzle 216 having a nozzle depth 218. The reactant mixture 214 may be dispensed onto a nozzle area such that the reactant mixture flows into the nozzles to a depth 220 of from about 1 μm to about 38.7 μm. As a further example, the reactant mixture flows into the nozzles to a depth 220 of from about 12 μm to about 35.5 μm.

The reactant mixture may also have good thixotropic (shear thinning) characteristics. A thixotropic fluid is a shear-thinning fluid which takes a finite amount of time to reach an equilibrium viscosity when introduced to a step change in shear rate. It is desirable that the reactant mixture has good shear thinning so that it is readily dispensable yet does not clog ejection head nozzles, for example.

The radiation cured member, or sealant, may possess a surface energy of from about 5 to about 90 dyne/cm, may possess an elongation at break of from about 1% to about 500%, and may have an average thickness ranging from about 1 and about 10,000 microns. Thicknesses of the radiation cured member in the range of from about 100 to about 500 microns have been observed to provide additional impact resistance or shock dampening benefits to the ejection heads. Another benefit of the radiation cured member is that it may be effective to remove particles and debris from an inner rim of the nozzles when the radiation cured member is removed from the nozzle area of the ejection head.

The radiation cured member may have a tensile strength of greater than about 100 $lbf/in^2$ ("psi"). As a further example, the radiation cured member may have a tensile strength of about 150 psi or greater. Suitable elongation results may be about 20% or greater. For example, low elongations (about 20% or less) may result in poor sealing. The reactant mixture should shear thin and may have a viscosity of about 50,000 centipoise ("cps") or greater at 15 rpm at 25° C. Further, the viscosity may be from about 50,000 cps to about 750,000 cps at 15 rpm at 25° C.

Removal

In another aspect, when the radiation cured member is used to protect or to seal a micro-fluid ejection head having nozzles, the radiation cured member may be removable, for example by an end user. Two components that govern the removal process include optimizing the balance between cohesive/adhesive strengths and initiating separation at a proper interface between the radiation cured member and the nozzles.

A removal member may be attached to the top surface of the radiation cured member, embedded in the radiation cured member, or applied underneath the radiation cured member. When attached to the top surface of the radiation cured member, the system may rely on the adhesion to the removal member being greater than the adhesion to a surface (for example, a nozzle area of a micro-fluid injection head). In this case, the cohesive strength of the radiation cured member is typically greater than the cohesive strength of removal member and the nozzle area. There are however competing requirements of adhesion. Modifications made to limit the adhesion of the radiation cured member to the nozzle area will in general also limit the adhesion to the removal member.

In another aspect, the removal member may adhere to the radiation cured member using either chemical adhesion or mechanical adhesion or both. In the instance where the removal member is a film, such as but not limited to polyethylene terephthalate (PET), the surface of the film may be roughened with a technique such as, but not limited to, corona treatment, plasma etch, or any number of chemical or physical abrasion methods.

As another example of providing mechanical adhesion of the removal member to the radiation cured member, the removal member may comprise a mesh (for example, a woven material). Such a material allows for the reactant mixture to wick through the mesh and, when cured, around the individual fibers of the mesh so that the cohesive strength of the radiation cured member becomes the dominating factor in removal. Experiments have shown that the mesh size of the removal member affects the success of removal. For example, when ultra small mesh openings (about 5 μm) are used, capillary action of the reactant mixture encourages wicking. However, after curing, the tiny portions of the radiation cured member that are sealed around the mesh may not provide sufficient strength for removal when the adhesive strength to the surface (for example, a nozzle area of a micro-fluid injection head) was substantially equal to the cohesive strength of the radiation cured member. Conversely if the mesh opening is too large (about 1 mm) the capillary action is not strong enough to encourage wicking and the individual fibers tend to pull out of the radiation cured member when the adhesive strength is too great. However both extremes have been shown to work when the adhesive strength of the radiation cured member to the surface is sufficiently low.

The removal member may comprise a synthetic fiber or a natural fiber. Synthetic fibers may provide very clean materials however they limit the bond strength created between the radiation cured member and the fibers. Synthetic fibers are simple in physical structure, typically smooth bore fibers. Natural fibers are often woven and offer improved adhesion properties. Fiber fragments provide additional interlocking features. In addition, natural fibers are often absorptive. When the reactant mixture is absorbed into the natural fibers and then cured it provides a strong mechanical interface with the natural fibers. The strands that protrude from the main fiber act as anchors further adhering the radiation cured member to the fiber.

When using a removal member that Is adhered to the outer surface of the sealant it is important to design the system around the cure mechanism that will be used. For a UV cure system the removal member must transmit enough UV radiation in the proper wavelengths to complete the cure. For a mesh it is possible to get UV through the mesh even if the individual fibers do not transmit in the UV wavelengths. A radiation cured member with strong "dark cure" is beneficial, which is one in which material in shaded regions will still cure as long as the cure has been initiated in the material.

Additional examples of a removal member include felt, foam, or even hook and loop fasteners such as a VELCRO-like material. The felt and foam would have similar properties to a woven mesh member. A felt or foam would allow the reactant mixture to wick up into the structure providing a strong mechanical seal after curing. A hook and loop fastener material would be similar to the natural fibers in providing anchors to the radiation cured member.

In some embodiments, the removal member may be embedded within the radiation cured member.

Figure 5:
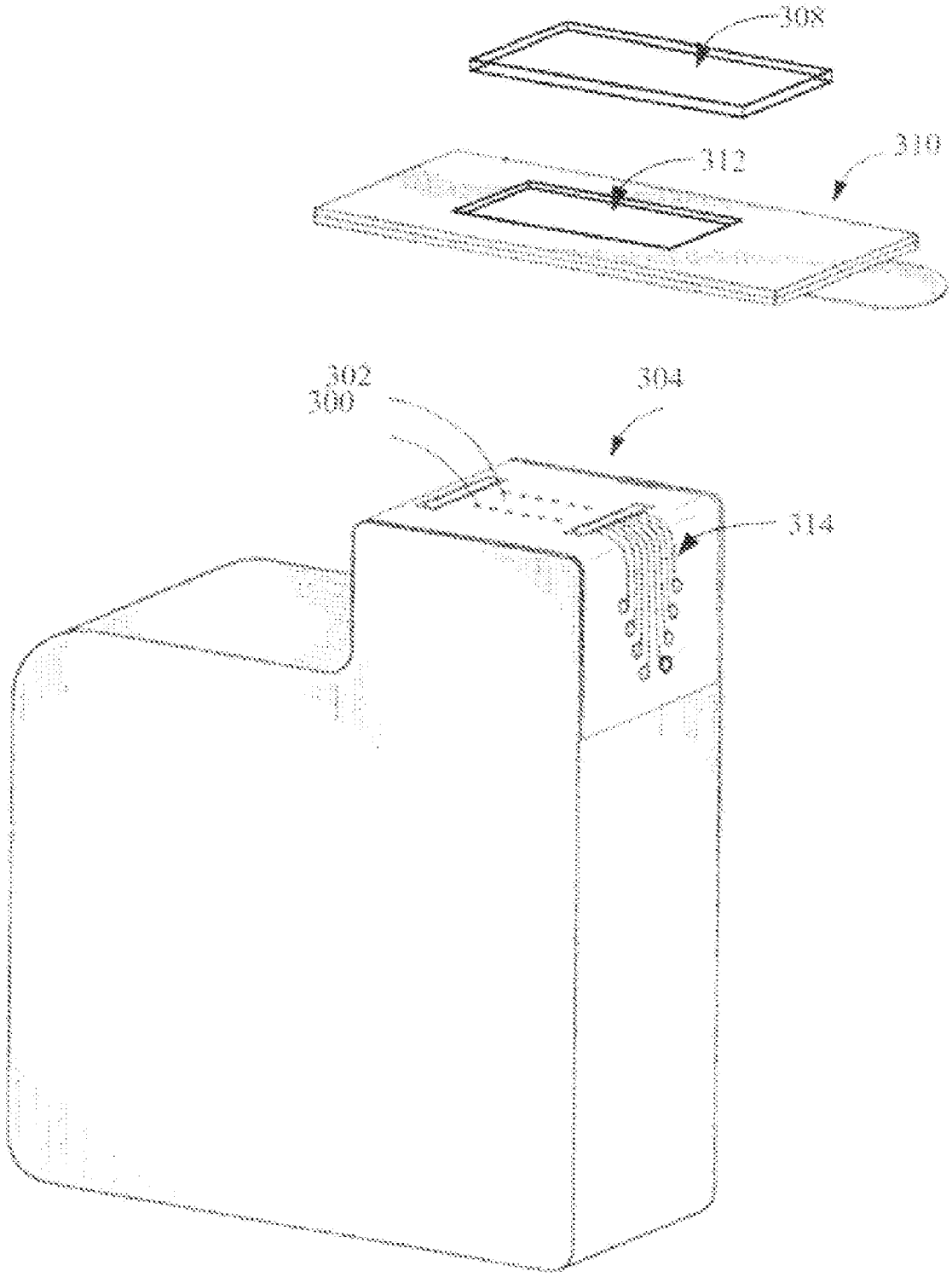
FIG. 5 is an exploded perspective view of a removable radiation cured member and removal member for sealing nozzles of an ejection head according to an embodiment of the disclosure.

In FIG. 5, a schematic drawing of a suitable embodiment of a radiation cured member 308 and a removal member 310 is shown. In such an embodiment, the removal member 310 may be attached between the radiation cured member 308 and the micro-fluid ejection head 304. Such an embodiment encourages separation at the proper interface, relies the least on chemical adhesion to the removal member, and interferes the least with the use of radiation curing. In this example, while the removal member 310 is located between the radiation cured member 308 and, for example, a nozzle area 302 containing nozzles 300 of a micro-fluid ejection head 304, the radiation cured member 308 must still be able to contact the nozzle area 302 and nozzles 300 directly. Further, it is important that the removal member 310 does not contact the nozzle area 302 or any of the nozzles 300. This may be done, for example, by having the removal member 310 only contact one or two edges of the radiation cured member 308 or by cutting a slot or hole 312 into the removal member 310 such that three or four sides of the removal member 310 contact the radiation cured member 308. In the embodiment where all four sides of the removal member 310 contact the radiation cured member 308, the slot 312 effectively becomes a window. It is still important to have good adhesion to the removal member 310, but that adhesion becomes less critical due to the removal member 310 applying force directly at the interface of the radiation cured member 308 to the micro-fluid ejection head 304. Further, the radiation cured member 308 may be positioned such that it also protects the electrical connections on the electrical circuit 314 of the micro-fluid ejection head.

Figure 6:
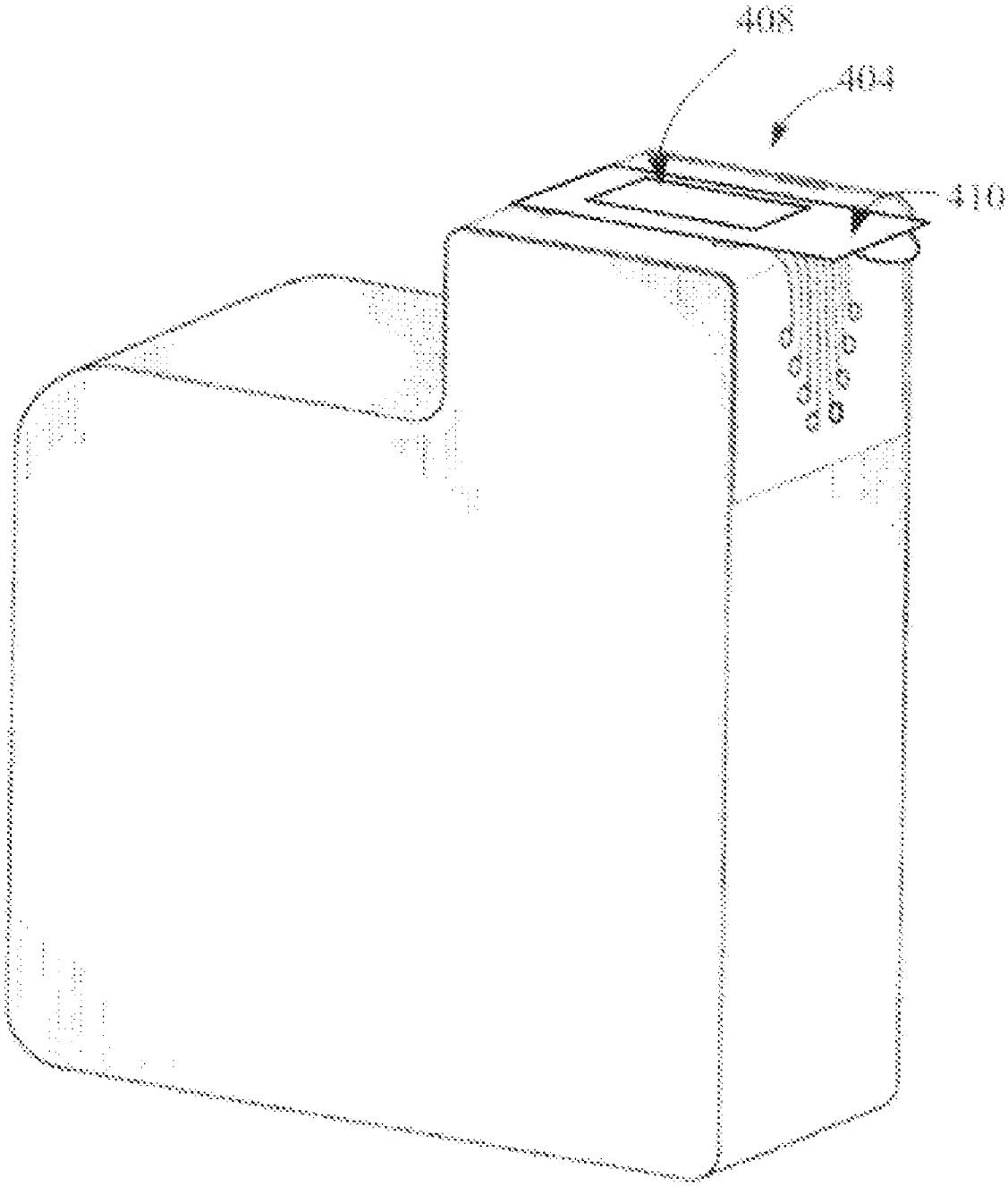
FIG. 6 is a perspective view of an assembled removable radiation cured member and removal member attached to a micro-fluid ejection head according to an embodiment of the disclosure.

FIG. 6 illustrates an example of a fully assembled protected micro-fluid ejection head 404 according to the present disclosure. The removal member 410 is applied directly to the micro-fluid ejection head 404. And the radiation cured member 408 is applied directly to the nozzle area through, for example, a window in the removal member 410 and overlaps the removal member 410.

In some embodiments, if the removal member is located between the radiation cured member and the surface, a PSA or a PSA tape may be used to attach the removal member to the surface prior to dispensing the reactant mixture to the surface. As a further example, a material similar to the existing tapes may be used as the removal member as well as the materials listed above with an adhesive layer.

Embodiments described herein may be used, for example, in the manufacture, re-manufacture, or re-fill of ejection heads. Some embodiments may be particularly valuable to a re-filler, as it is more difficult to tape an ejection head that has already been used. Further, present embodiments may provide the added benefit of cleaning the nozzle area upon removal.

EXAMPLES

Formulations according to the present disclosure as well as comparative examples were prepared and are shown in Table I. Samples 1-4 represent embodiments having good functional performance. Samples 5-10 are comparative and demonstrate poor functional performance. All of the samples included at least one acrylate oligomer, reactive diluent, filler or additive, and photoinitiator. Weight percents of each component are given in Table I.

Samples 1-4 were formulated with CN9782 (available from Sartomer) which is a high molecular weight aromatic urethane diacrylate oligomer. Sample 5 was formulated with EBECRYL 3708 (available from Cytec Industries Inc.) which is a bisphenol-A modified epoxy diacrylate oligomer. Sample 6 was formulated with KANEKA RC100C (available from Kaneka Corp.) which is a high molecular weight acrylic diacrylate oligomer. Sample 7 was formulated with GENOMER 4269 (available from Rahn) which is a medium molecular weight aliphatic urethane diacrylate oligomer. Sample 8 was formulated with both CN9782 and GENOMER 4269, which are a high molecular weight aromatic urethane diacrylate oligomer and a medium molecular weight aliphatic urethane diacrylate oligomer, respectively. Sample 9 was formulated with EBECRYL 8411 (available from Cytec Industries Inc.) which is a high molecular weight aliphatic urethane diacrylate oligomer containing isobornyl acrylate monomer. Sample 10 was formulated with both CN965 and CN966J75 (both available from Sartomer) which are a medium molecular weight aliphatic polyester-based urethane diacrylate oligomer and a high molecular weight aliphatic urethane diacrylate oligomer, respectively. By high molecular weight is meant from about 7000 g/mole to about 25000 g/mole. By medium molecular weight is meant from about 2000 g/mole to about 7000 g/mole.

Examples of the generalized chemical structures of the three tested types of acrylate oligomers are shown below. Structure I is a urethane diacrylate. Structure II is an epoxy diacrylate. Structure III is an acrylic acrylate.

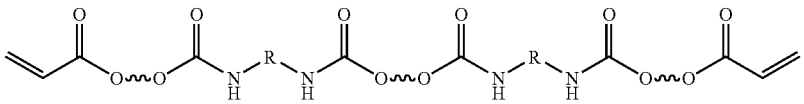

Structure I. Urethane diacrylate.

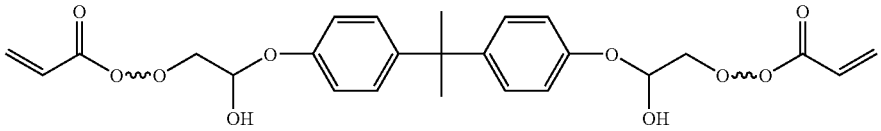

Structure II. Epoxy diacrylate.

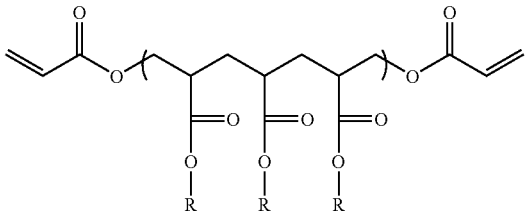

Structure III. Acrylic acrylate.

In the above structures, the letter "R" and the curved lines represent an aliphatic or aromatic spacing groups. The foregoing structures are not intended to be exact structures, but are intended to convey the type of functionality in each oligomer type.

In Table I, the glass transition temperature (in ° C.) is given for each of the acrylate oligomers.

The reactive diluents used for the present examples included NPG(PO)2DA (available from UCB Chemicals Corp.) which is a diacrylate of propoxylated neopentyl glycol and GENOMER 1122 (available from Rahn) which is a low viscosity monofunctional aliphatic urethane acrylate.

The filler or additive component used for the present examples included fumed silica. Specifically, the fumed silica components tested were AEROSIL R711, R972, and R812, all available from Degussa. AEROSIL R711 is fumed silica aftertreated with a methacrylsilane based on AEROSIL® 200 (which is a very pure form of silicon dioxide aerosol obtained by flame hydrolysis). AEROSIL R812 is a fumed silica aftertreated with HMDS (hexamethyldisilazane) based on AEROSIL® 300 (which is a hydrophilic fumed silica with a specific surface area of 300 $m^2/g$). AEROSIL R972 is a hydrophobic turned silica after treated with DDS (dimethyldichlorosilane) based on a hydrophilic fumed silica with a specific surface area of 130 $m^2/g$.

The photoinitiator used was ADDITOL CPK (available from Surface Specialties UCB) which is a 1-Hydroxy-cyclohexylphenyl-ketone and is an alpha cleavage photoinitiator.

TABLE I

| Raw Material | Component, wt % | | | | | | | | | | | | | |
|---|---|---|---|---|---|---|---|---|---|---|---|---|---|---|
| Class | | Oligomer Class | Mol Wt | Tg | 1 | 2 | 3 | 4 | 5 | 6 | 7 | 8 | 9 | 10 |
| Acrylate Oligomers | CN9782 | Urethane diacrylate oligomer | High | −32 | 79 | 77 | 77 | 77 | | | | 42 | | |
| | Kaneka RC100C | Acrylic diacrylate oligomer | High | −55 | | | | | | 83 | | | | |
| | GENOMER 4269 | Urethane diacrylate oligomer | Med | −15 | | | | | | | 83 | 42 | | |
| | EBECRYL 8411 | Urethane diacrylate oligomer | High | −18 | | | | | | | | | 93 | |
| | CN965 | Urethane diacrylate oligomer | Med | −37 | | | | | | | | | | 49 |
| | CN966J75 | Urethane diacrylate oligomer | High | −33 | | | | | | | | | | 49 |
| | Ebecryl 3708 | Epoxy diacrylate oligomer | | 21 | | | | | 84 | | | | | |
| Reactive Diluents | | NPG(PO)2DA | | | 10 | 17 | 10 | 12 | 10 | 10 | 10 | 10 | | |
| | | GENOMER 1122 | | | 5 | | 7 | 5 | | | | | | |
| Fumed Silica | | AEROSIL R711 | | | 4 | 4 | | | | | | | | |
| | | AEROSIL R972 | | | | | 4 | 4 | | 5 | 5 | 4 | | |
| | | AEROSIL R812 | | | | | | | 4 | | | | 5 | |
| Photoinitiator | | ADDITOL CPK | | | 2 | 2 | 2 | 2 | 2 | 2 | 2 | 2 | 2 | 2 |
| | | Total, wt % | | | 100 | 100 | 100 | 100 | 100 | 100 | 100 | 100 | 100 | 100 |

TABLE II

| | | Sample | | | | | | | | | |
|---|---|---|---|---|---|---|---|---|---|---|---|
| Type | Physical Properties | 1 | 2 | 3 | 4 | 5 | 6 | 7 | 8 | 9 | 10 |
| Uncured Sealant | Viscosity 1 rpm (×1000 cps) | 280 | 229 | 244 | 334 | 253 | 171 | 49 | 188 | 550 | 127 |
| | Viscosity 15 rpm (×1000 cps) | 179 | 159 | 161 | 207 | 150 | 84 | 37 | 97 | 360 | 125 |
| Cured Sealant | Tensile Strength (PSI) | 494 | 366 | 280 | 241 | | 23 | 69 | 126 | 461 | 461 |
| | Elongation (%) | 65 | 40 | 53 | 47 | | 40 | 25 | 30 | 47 | 47 |

TABLE III

| | Sample | | | | | | | | | |
|---|---|---|---|---|---|---|---|---|---|---|
| | 1 | 2 | 3 | 4 | 5 | 6 | 7 | 8 | 9 | 10 |
| Functional Testing | Good Functional Performance | | | | Poor Functional Performance | | | | | |
| Issues | | | | | Sealant "pops" off ejection head during 60° C. aging | Some nozzles are clogged | Some nozzles are clogged | Some nozzles are clogged | Uncured sealant does not dispense onto ejection head | Uncured sealant can not be applied to the ejection head with the tooling |

TABLE III-continued

| | Sample | | | | | | | | | |
|---|---|---|---|---|---|---|---|---|---|---|
| | 1 | 2 | 3 | 4 | 5 | 6 | 7 | 8 | 9 | 10 |
| Reasoning | | | | | Sealant is too stiff and has a high modulus | Sealant has poor cohesion and low tensile strength | Sealant has poor cohesion and low tensile strength | Sealant has poor cohesion and low tensile strength | Viscosity of uncured sealant is too high | Uncured sealant has no shear thinning |

Each of the samples was tested before curing with UV radiation and after curing. The results are shown in Table II. Before curing, the viscosity of the reactant mixture was tested at both 1 rpm and 15 rpm on a Brookfield viscometer. After curing, the tensile strength and elongation were tested. It was found that each of samples 1-4 provided desirable results in the tests for both before and after curing. Samples 1-4 provided viscosity values between about 100,000 and 750,000 cps for the uncured sample. Further, after curing, samples 1-4 provided tensile strength values of greater than about 150 psi and elongation of about 20% or greater.

Each of the samples was subjected to functional testing. For functional testing, mono and color versions of micro-fluid ejection heads were used to print a functional test page. Then each ejection head was sealed with, one of samples 1-10. The sealed ejection head was placed in an oven at 60° C. for 1 week to simulate accelerated aging. The sealant was then removed. Each ejection head was then used to print another test page. The number of functional printing nozzles was compared to the data before sealing. Further the nozzles were also evaluated for misdirection. The data from these tests is shown in Table III.

As shown by the data in Tables 1-3, it is not one single sample characteristic that imparts desired performance but the combination of characteristics, including, but not limited to, tensile strength, elongation, viscosity, and shear thinning.

At numerous places throughout this specification, reference has been made to a number of U.S. Patents. All such cited documents are expressly incorporated in full into this disclosure as if fully set forth herein.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

What is claimed is:

1. A method of protecting a nozzle area containing nozzles on a micro-fluid ejection head with a removable cured member comprising:

applying a liquid reactant mixture to a nozzle area containing nozzles on a micro-fluid ejection head; and exposing the reactant mixture to radiation to provide a removable cured, solid film member that users peel from the nozzle area before use.

2. The method according to claim 1, wherein the reactant mixture comprises a vinyl-containing oligomer, a filler, and optionally a reactive diluent and/or a photoinitiator.

3. The method according to claim 1, wherein the reactant mixture comprises a monomer or an oligomer having a polymerizable functionality, wherein the polymerizable functionality comprises one or more of a vinyl, acrylate, vinyl ether, or methacrylate functional group.

4. The method according to claim 1, wherein applying the reactant mixture to the nozzle area comprises applying the reactant mixture to the nozzle area by extrusion.

5. The method according to claim 1, wherein applying the reactant mixture to the nozzle area comprises applying the reactant mixture to the nozzle area by one of roll coating, spraying, stencil printing, or extruding through a needle.

6. The method according to claim 1, wherein exposing the reactant mixture to radiation comprises exposing the reactant mixture to one of ultraviolet radiation, an electron beam, visible light, and an inert atmosphere.

7. The method according to claim 1, wherein exposing the reactant mixture to radiation comprises exposing the reactant mixture to an inert atmosphere, and wherein further the inert atmosphere comprises a non-reactive gas.

8. The method according to claim 7, wherein the non-reactive gas comprises nitrogen or argon.

9. The method according to claim 1, wherein exposing the reactant mixture to radiation comprises exposing the reactant mixture to optimized, directed, focused, or dispersed radiation.

10. The method according to claim 9, wherein exposing the reactant mixture to radiation comprises exposing the reactant mixture to radiation optimized, directed, focused, or dispersed by optical mirrors, optical lenses, dichroic filters, or electromagnetic lenses.

11. The method according to claim 1, wherein applying a reactant mixture to the nozzle area comprises applying the reactant mixture as a first layer to the nozzle area.

12. The method according to claim 11, further comprising:

applying a second reactant mixture as a second layer to the nozzle area and exposing the second reactant mixture to radiation.

13. The method according to claim 1, wherein the reactant mixture is substantially free of organic solvents.

14. The method according to claim 1, further comprising: removing the removable cured member from the nozzle area.

15. The method according to claim 1, further comprising: attaching a removal member to the nozzle area.

16. The method according to claim 15, wherein attaching the removal member to the removable cured member comprises one of attaching the removal member to a top surface of the removable cured member, embedding the removal member within the removable cured member, or attaching the removal member to a surface between the removable cured member and the micro-fluid ejection head.

17. The method according to claim 16, wherein the removal member comprises a synthetic or a natural fiber.

18. The method according to claim 16, wherein the removal member comprises polyethylene terephthalate.

19. The method according to claim 16, wherein the removal member comprises at least one of a mesh, a felt, a foam, or a Velcro-like substance.

20. The method according to claim 15, wherein attaching the removal member to the removable cured member comprises attaching the removal member to the removable cured member by chemical adhesion.

21. The method according to claim 15, wherein attaching the removal member to the removable cured member comprises attaching the removal member to the removable cured member by mechanical adhesion.

22. The method according to claim 1, further comprising attaching a removal member to the micro-fluid ejection head prior to applying a reactant mixture.

23. The method according to claim 22, wherein the removal member comprises a pressure-sensitive adhesive tape.

24. A micro-fluid ejection head having nozzles sealed by a removable radiation cured member, wherein the removable radiation cured member comprises a solid film that users peel from the nozzle area before use of the micro-fluid ejection head that is the radiation reaction product of a liquid vinyl-containing oligomer, a filler, and optionally a reactive diluent, and/or a photoinitiator residing on the nozzles, wherein the removable radiation cured member further comprises a surface energy between about 5 to about 90 dyne/cm.

25. The micro-fluid ejection head having nozzles sealed by the removable radiation cured member of claim 24, wherein the removable radiation cured member comprises a free-radically polymerized acrylate oligomer.

26. The micro-fluid ejection head having nozzles sealed by the removable radiation cured member of claim 25, wherein the removable radiation cured member comprises a free-radically polymerized urethane oligomer.

27. The micro-fluid ejection head having nozzles sealed by the removable radiation cured member of claim 25, wherein the removable radiation cured member comprises an elongation at break of about 1% to about 500%.

28. The micro-fluid ejection head having nozzles sealed by the removable radiation cured member of claim 25, wherein the removable radiation cured member comprises a thickness of from about 1 to about 10,000 microns.

29. A micro-fluid ejection head having nozzles sealed by a removable member, wherein the removable member comprises a solid film that users peel from the nozzle area before use of the micro-fluid ejection head that is the radiation reaction product of a liquid vinyl-containing oligomer, a filler, and optionally a reactive diluent, and/or a photoinitiator residing on the nozzles, wherein the removable radiation cured member comprises a free-radically polymerized acylate oligomer, and wherein the removable radiation cured member comprises a tensile strength of greater than about 100 $lbf/in^2$ ("psi").

30. The micro-fluid ejection head having nozzles sealed by a removable member of claim 25, wherein the removable radiation cured member comprises a tensile strength of about 150 psi or greater.

31. The micro-fluid ejection head of claim 24, further including a removal member film defining a window around the nozzles but not contacting the nozzles.

32. The micro-fluid ejection head of claim 31, wherein the removable radiation cured member substantially fills the window of the removal member film and seals the nozzles.

33. The micro-fluid ejection head of claim 32, wherein the window and the removable radiation cured member define rectangular shapes, the window contacting the removable radiation cured member on four sides of the rectangular shape.

34. The micro-fluid ejection head of claim 32, wherein the window and the removable radiation cured member together have a singular common thickness as the removable radiation cured member said substantially fills the window.

35. The method of claim 1, further including applying a removal member film to the micro-fluid ejection head, but not contacting the nozzles.

36. The method of claim 35, wherein the applying the liquid reactant mixture to the nozzle area containing nozzles on the micro-fluid ejection head further includes filling a window of the removal member film surrounding the nozzles with the liquid reactant mixture.

37. The method of claim 36, further including curing in place the liquid reactant mixture in the window of the removable member film to obtain the removable cured, solid film member that users said peel from the nozzle area before use.

* * * * *